US008641164B2

(12) United States Patent
Kondo et al.

(10) Patent No.: US 8,641,164 B2
(45) Date of Patent: Feb. 4, 2014

(54) CORRECTED VALUE CALCULATION METHOD AND PRINTING DEVICE

(75) Inventors: Takamitsu Kondo, Shiojiri (JP); Toru Takahashi, Azumino (JP); Hiroshi Wada, Azumino (JP); Kazuyoshi Tanase, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 168 days.

(21) Appl. No.: 13/404,378

(22) Filed: Feb. 24, 2012

(65) Prior Publication Data

US 2012/0218335 A1 Aug. 30, 2012

(30) Foreign Application Priority Data

Feb. 25, 2011 (JP) ..... 2011-040241

(51) Int. Cl.
*B41J 29/393* (2006.01)

(52) U.S. Cl.
USPC ..... 347/19; 347/42

(58) Field of Classification Search
CPC ..... B41J 2/155; B41J 2/2146; B41J 2/245; B41J 2/515; B41J 2/04501; B41J 2/04505
USPC ..... 347/13, 19, 41, 42
See application file for complete search history.

(56) References Cited

U.S. PATENT DOCUMENTS

| | | | | |
|---|---|---|---|---|
| 8,205,953 | B2 * | 6/2012 | Azuma et al. | 347/14 |
| 2008/0284804 | A1 * | 11/2008 | Seccombe | 347/9 |
| 2009/0219317 | A1 * | 9/2009 | Masuyama | 347/12 |
| 2011/0012949 | A1 * | 1/2011 | Enge | 347/12 |

FOREIGN PATENT DOCUMENTS

| | | | |
|---|---|---|---|
| JP | 2009-226904 | A | 10/2009 |
| JP | 2010-188632 | A | 9/2010 |

* cited by examiner

*Primary Examiner* — Julian Huffman
*Assistant Examiner* — Sharon A Polk
(74) *Attorney, Agent, or Firm* — Global IP Counselors, LLP

(57) ABSTRACT

A density correction value calculation method for a printing device comprising: (A) determining the density of each pixel column composed of pixels aligned in the intersecting direction in a duty determination pattern, and also determining the density of each pixel column in the duty determination pattern; (B) specifying the total duty for which the lowest density of the pixel column densities of the overlapping regions is equal to or greater than the lowest density in the pixel columns of the non-overlapping regions; and (C) calculating a density correction value of the pixel columns using a density correction pattern formed with the specified total duty, and also calculating a density correction value so that the lowest density of the pixel column densities of the density correction pattern is a reference.

8 Claims, 10 Drawing Sheets

| | duty | | | | | |
|---|---|---|---|---|---|---|
| | 1ST REGION | 2ND REGION | 3RD REGION | 4TH REGION | 5TH REGION | 6TH REGION |
| UPSTREAM HEADS | 50 | 60 | 70 | 80 | 90 | 100 |
| DOWNSTREAM HEADS | 50 | 60 | 70 | 80 | 90 | 100 |
| total duty | 100 | 120 | 140 | 160 | 180 | 200 |

CORRECTED VALUE CALCULATION METHOD AND PRINTING DEVICE

CROSS-REFERENCE TO RELATED APPLICATIONS

This application claims priority to Japanese Patent Application No. 2011-040241 filed on Feb. 25, 2011. The entire disclosure of Japanese Patent Application No. 2011-040241 is hereby incorporated herein by reference.

BACKGROUND

1. Technical Field

The present invention relates to a corrected value calculation method and a printing device.

2. Background Technology

One example of a fluid ejection device is an inkjet printer (hereinbelow, a printer) in which ink (a fluid) is ejected from nozzles provided to a head to form an image. Such printers include those in which a plurality of rectangular heads are aligned in a paper width direction, and ink is ejected from the heads onto a medium conveyed below the heads to form an image.

In such a printer, there is a portion where the ends of the heads overlap in the direction of nozzle alignment, i.e., in the joint of the heads (hereinbelow referred to as the "overlapping region"). With such a configuration, the heads are disposed separated in relation to their relative movement direction with the medium, and the deposited positions of the ink are therefore sometimes misaligned because of shifting of the medium. As a result, density changes occur in the overlapping region, but there is also a technique for performing a density correction for each raster line (also referred to as a pixel column) in order to correct these changes. With this technique, a test pattern is printed, a correction is performed such that less ink is ejected from nozzles that tend to form raster lines of high density, and a correction is performed such that more ink is ejected from nozzles that tend to form raster lines of low density.

Patent Citation 1 shows that the discharge amount is corrected so that the amounts of ink discharged from the heads are constant. Patent Citation 2 discloses a printer in which the ends of the heads (part of the nozzles columns) are made to overlap and a plurality of heads are disposed.

Japanese Patent Application Publication No. 2010-188632 (Patent Citation 1) and Japanese Patent Application Publication No. 2009-226904 (Patent Citation 2) are examples of the related art.

SUMMARY

Problems to Be Solved by the Invention

However, the reference for judging magnitudes of density in the density correction is a magnitude of density associated with an average value of all the nozzles. Depending on the average value, the correction will then sometimes be insufficient in high-duty (high-density) printing. For example, if a correction is made such that printing is performed with a duty higher than the highest duty, it will not be possible to output any higher of a duty, and as a result, the density will be insufficient. Consequently, it is preferable that it be made possible to perform density correction appropriately. The invention was devised in view of such circumstances, and an advantage thereof is to make it possible to perform density correction appropriately.

Means Used to Solve the Above-Mentioned Problems

A primary aspect for achieving the advantage described above is:

a correction value calculation method for a printing device including:

a first nozzle column in which first nozzles for ejecting ink are aligned in a predetermined direction;

a second nozzle column in which second nozzles for ejecting the ink are aligned in the predetermined direction, the second nozzle column being disposed to form an overlapping region in which an end on one side in the predetermined direction overlaps an end on the other side in the predetermined direction of the first nozzle column; and a movement part for relatively moving a medium in an intersecting direction that intersects the predetermined direction;

wherein the printing device ejects the ink in the overlapping region with a total duty divided between the first nozzles and the second nozzles;

the correction value calculation method including the steps of:

(A) determining the density of each pixel column composed of pixels aligned in the intersecting direction in a duty determination pattern, and also determining the density of each pixel column in the duty determination pattern in which a plurality of overlapping region patterns are formed with a total duty higher than the highest duty of non-overlapping regions which are not the overlapping regions;

(B) specifying the total duty for which the lowest density of the pixel column densities of the overlapping regions is equal to or greater than the lowest density in the pixel columns of the non-overlapping regions; and (C) calculating a density correction value of the pixel columns using a density correction pattern formed with the specified total duty, and also calculating a density correction value so that the lowest density of the pixel column densities of the density correction pattern is a reference.

Other characteristics of the invention are made clear by the present specification and the descriptions of the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1A:
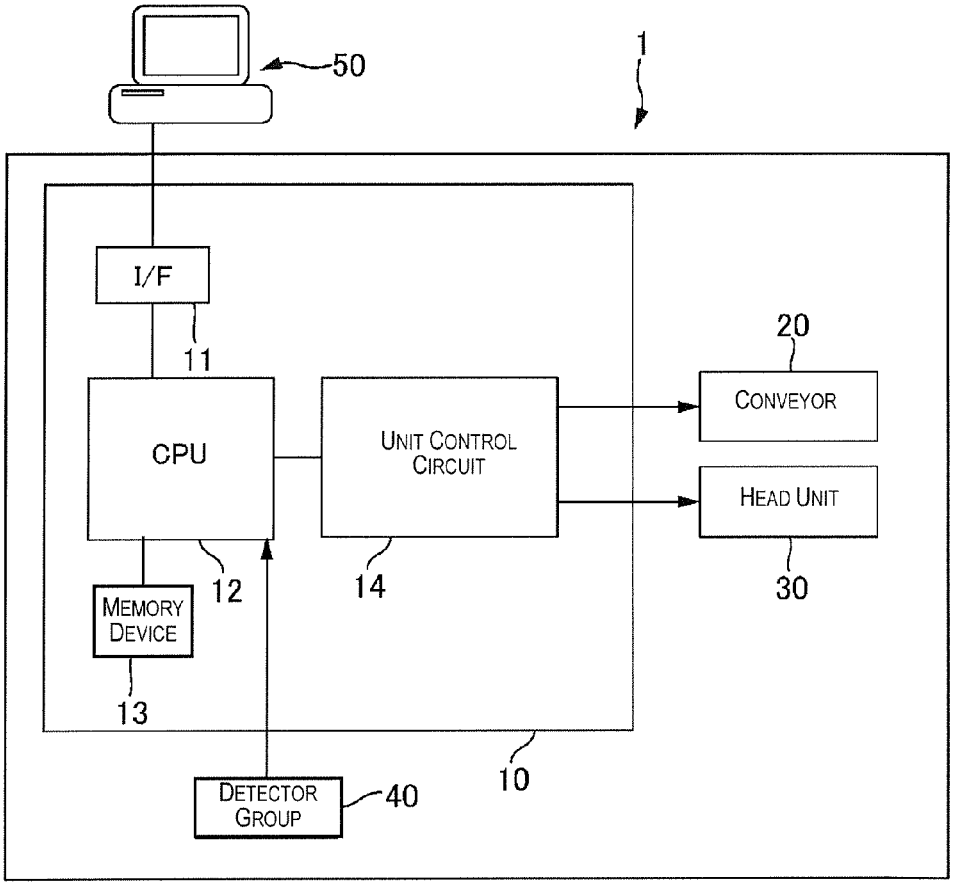
FIG. 1A is an overall configuration block diagram of the printer 1.

At least the following matters are made clear by the present specification and the descriptions of the accompanying drawings.

A correction value calculation method for a printing device including:

a first nozzle column in which first nozzles for ejecting ink are aligned in a predetermined direction;

a second nozzle column in which second nozzles for ejecting the ink are aligned in the predetermined direction, the second nozzle column being disposed to form an overlapping region in which an end on one side in the predetermined direction overlaps an end on the other side in the predetermined direction of the first nozzle column; and a movement part for relatively moving a medium in an intersecting direction that intersects the predetermined direction;

wherein the printing device ejects the ink in the overlapping region with a total duty divided between the first nozzles and the second nozzles;

the correction value calculation method including the steps of:

(A) determining the density of each pixel column composed of pixels aligned in the intersecting direction in a duty determination pattern, and also determining the density of each pixel column in the duty determination pattern in which a plurality of overlapping region patterns are formed with a total duty higher than the highest duty of non-overlapping regions which are not the overlapping regions;

(B) specifying the total duty for which the lowest density of the pixel column densities of the overlapping regions is equal to or greater than the lowest density in the pixel columns of the non-overlapping regions; and (C) calculating a density correction value of the pixel columns using a density correction pattern formed with the specified total duty, and also calculating a density correction value so that the lowest density of the pixel column densities of the density correction pattern is a reference.

The density tends to decrease in the overlapping regions, but the method described above makes it possible to increase duty in the overlapping regions to increase the density. Since density correction is performed using a density correction pattern having a total duty such that the lowest density of the pixel column densities of the overlapping regions is equal to or greater than the lowest density in the pixel columns of the non-overlapping regions, it is possible to perform density correction appropriately without causing density insufficiency or loss of coloring performance.

In this correction value calculation method, it is preferable that a plurality of the overlapping region patterns of the duty determination pattern be formed with total duties that differ incrementally. Doing so makes it possible to select an appropriate total duty.

It is preferable that the overlapping region patterns of the duty determination pattern be formed with a duty divided equally between the first nozzles and the second nozzles. Doing so makes it possible to appropriately divide the duty with which ink is ejected between the first nozzles and the second nozzles.

It is preferable that the density correction pattern be a pattern for performing a density correction for each pixel column composed of pixels aligned in the intersecting direction. Doing so makes it possible to perform a density correction for each pixel column.

It is preferable that when the density correction value is calculated, the density of the formed density correction pattern be determined in units of the pixel columns, and the density correction value be calculated based on the densities of each of the determined pixel columns. Doing so makes it possible to calculate an appropriate density correction value on the basis of the determined density of each pixel column.

It is preferable that when the density correction value is calculated, the density correction value be calculated by multiplying a ratio such that the lowest density of the densities of pixel columns of the density correction pattern is a reference. Doing so makes it possible to calculate a density correction value such that the lowest density of the densities of pixel columns of the density correction pattern is a reference.

It is preferable that during formation of the duty determination pattern, patterns in the non-overlapping regions be formed with only the highest duty. Doing so makes it possible to measure the density when ink is ejected with the highest duty in the non-overlapping regions.

At least the following matters are made clear by the present specification and the descriptions of the accompanying drawings.

Specifically, provided is a printing device for performing printing by performing a correction for each of the pixel columns with the density correction value determined by the correction value calculation method according to the above descriptions. This printing device makes it possible to perform printing with an appropriate density correction.

—System Configuration—

An embodiment is described wherein the fluid ejection device is a printing system in which a line head printer (hereinbelow, the printer 1), one example of an inkjet printer, and a computer 50 are connected.

Figure 1B:
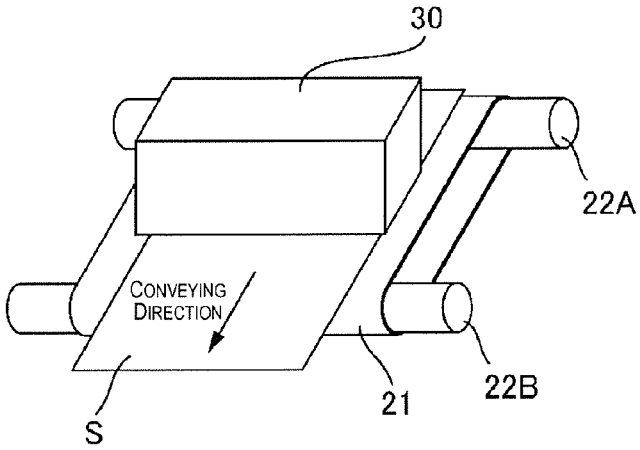
FIG. 1B is a schematic view of the printer 1.

FIG. 1A is an overall configuration block diagram of the printer 1, and FIG. 1B is a schematic view of the printer 1, showing the manner in which the printer 1 conveys paper S (a medium). After receiving print data from the computer 50 which is an external device, the printer 1 controls other units (a conveyor 20, a head unit 30) through a controller 10 and prints an image on the paper S. The conditions in the printer 1 are monitored by a detector group 40, and the controller 10 controls the other units based on the detection results.

The controller 10 is a control unit for performing controls on the printer 1. An interface 11 is for transmitting and receiving data between the printer 1 and the computer 50 which is an external device. A CPU 12 is a computation processing device for performing controls on the entire printer 1. A memory device 13 is for ensuring working regions, regions for storing the programs of the CPU 12, and the like. The CPU 12 controls the other units through a unit control circuit 14 according to the programs stored in the memory device 13.

The conveyor 20 has a conveying belt 21 and conveying rollers 22A, 22B, the paper S is fed in to a printable position, and the paper S is conveyed at a predetermined conveying rate in a conveying direction. After the paper S is supplied onto the conveying belt 21, the conveying belt 21 is rotated by the conveying rollers 22A, 22B, and the paper S on the conveying belt 21 is thereby conveyed. The paper S on the conveying belt 21 can be held in place from below by electrostatic adsorption or vacuum adsorption.

The head unit 30, which is for ejecting ink droplets onto the paper S, has a plurality of heads 31. A plurality of nozzles, which are ink ejection parts, are provided in the bottom surfaces of the heads 31. Each of the nozzles is provided with a pressure chamber (not shown) into which ink enters, and a drive element (piezo element) for changing the capacity of the pressure chamber and ejecting ink.

With such a printer 1, when the controller 10 receives print data, the controller 10 first feeds the paper S onto the conveying belt 21. The paper S is then conveyed without stopping on the conveying belt 21 at a constant rate, and the paper S faces the nozzle surfaces of the heads 31. While the paper S is being conveyed beneath the head unit 30, ink droplets are ejected intermittently from the nozzles on the basis of image data. As a result, dot columns are formed along the conveying direction on the paper S, and an image is printed. The image data is configured from a plurality of pixels disposed two-dimensionally, and the pixels (data) indicate whether or not dots are formed in the regions (pixel regions) on the medium corresponding to the pixels.

<Nozzle Disposition>

Figure 2A:
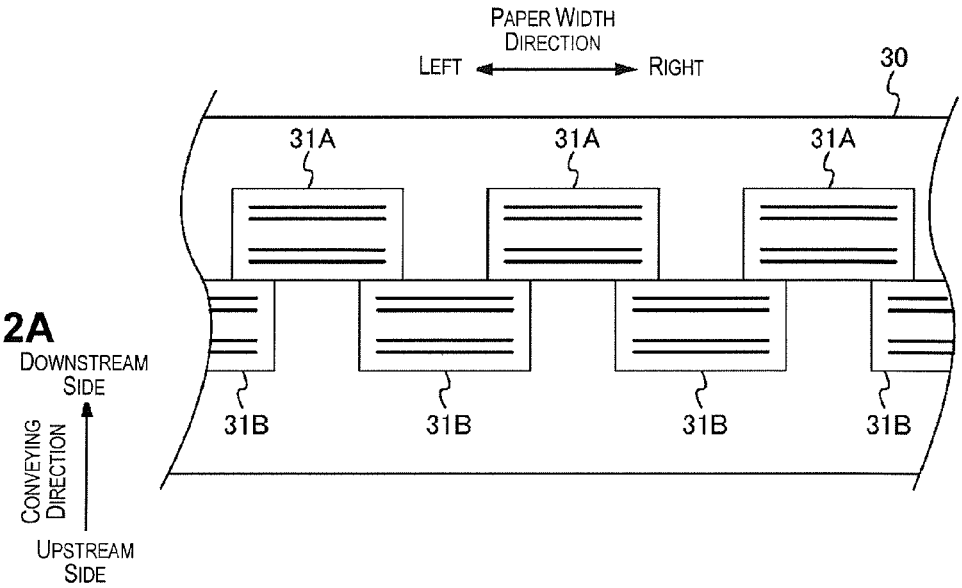
FIG. 2A is a drawing showing the array of heads 31 provided to the head unit 30.
Figure 2B:
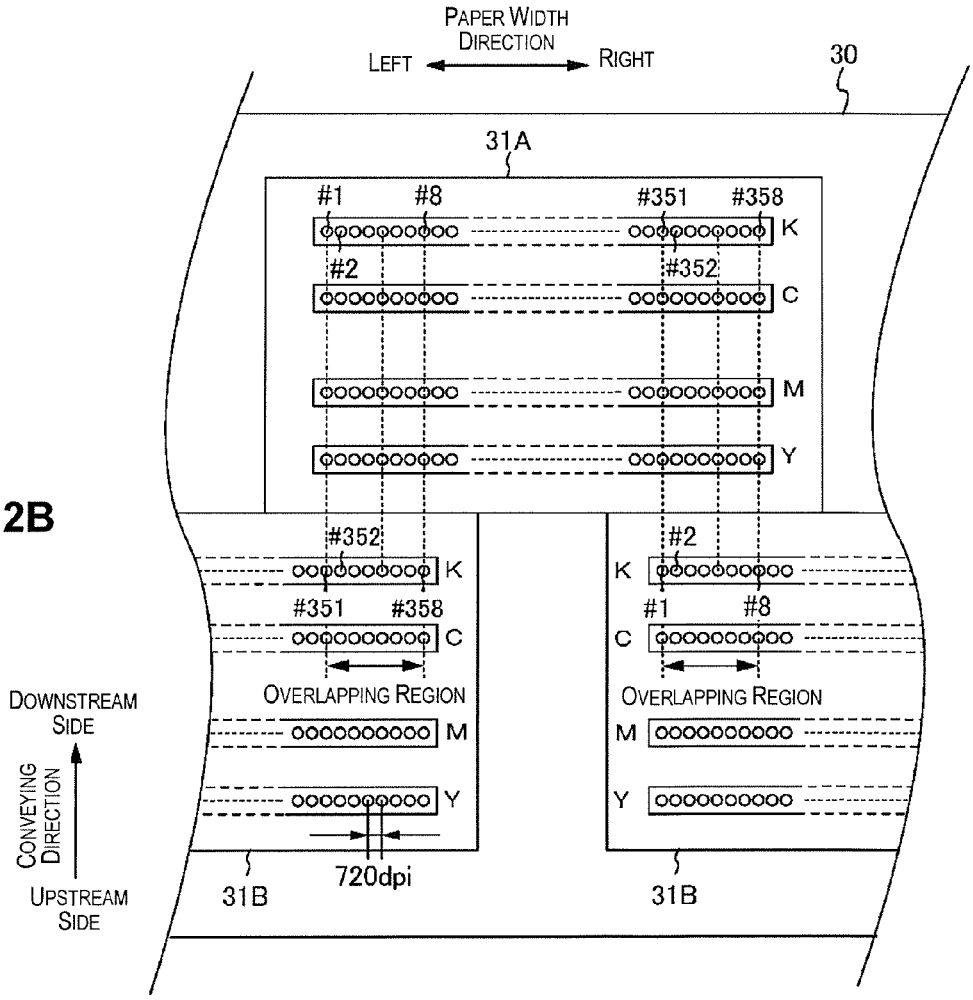
FIG. 2B is a drawing showing the nozzle arrays in the bottom surfaces of the heads 31.

FIG. 2A is a drawing showing the array of heads 31 provided to the head unit 30, and FIG. 2B is a drawing showing the nozzle arrays in the bottom surfaces of the heads 31. In the printer 1 of the present embodiment, the plurality of heads 31 are disposed in alignment in the paper width direction which intersects the conveying direction, and the ends of the heads 31 are disposed overlapping. Heads 31A, 31B that are adjacent in the paper width direction are disposed out of alignment (disposed in a staggered formation). Of these heads 31A, 31B that are adjacent in the paper width direction, the heads 31A that are downstream side in the conveying direction are referred to as the "downstream heads 31A," and the heads 31B that are upstream side in the conveying direction are referred to as the "upstream heads 31B." The heads 31A, 31B that are adjacent in the paper width direction are referred to together as "adjacent heads."

In FIG. 2B, the nozzles are seen transparently through the tops of the heads. In the bottom surface of each of the heads 31 are formed a black nozzle column K for ejecting black ink, a cyan nozzle column C for ejecting cyan ink, a magenta nozzle column M for ejecting magenta ink, and a yellow nozzle column Y for ejecting yellow ink, as shown in FIG. 2B. The nozzle columns are each configured from 358 nozzles (#1 to #358). The nozzles of each of the nozzle columns are aligned in constant intervals (e.g., 720 dpi) in the paper width direction. The nozzles belonging to each of the nozzle columns are denoted by numbers that start small and progress from the left in the paper width direction (#1 to #358).

The heads 31A, 31B aligned in the paper width direction are disposed so that eight nozzles overlap at the ends of the nozzle columns of each head 31. Specifically, the eight nozzles (#1 to #8) in the left ends of the nozzle columns of the downstream heads 31A overlap with the eight nozzles (#351 to #358) of the right ends of the nozzle columns of the upstream heads 31B, and the eight nozzles (#351 to #358) in the right ends of the nozzle columns of the downstream heads 31A overlap with the eight nozzles (#1 to #8) of the left ends of the nozzle columns of the upstream heads 31B. In the adjacent heads 31A, 31B, portions where the nozzles overlap are referred to as "overlapping regions," as shown in the drawings. The nozzles (#1 to 8 and #351 to #358) belonging to the overlapping regions are referred to as "overlapping nozzles."

Nozzles that overlap in the ends of the heads 31A, 31B aligned in the paper width direction have coinciding positions in the paper width direction. Specifically, the positions of end nozzles in the downstream heads 31A in the paper width direction are the same positions of the corresponding end nozzles in the upstream heads 31B in the paper width direction. For example, the nozzles #1 in the leftmost ends of the downstream heads 31A and the nozzles #351 which are eighth from the right in the upstream heads 31B have the same positions in the paper width direction, and the nozzles #8 which are eighth from the left in the downstream heads 31A and the nozzles #358 in the rightmost ends of the upstream heads 31B have the same positions in the paper width direction. The nozzles #358 in the rightmost ends of the downstream heads 31A and the nozzles #8 which are eighth from the left in the upstream heads 31B have the same positions in the paper width direction, and the nozzles #351 which are eighth from the right in the downstream heads 31A and the nozzles #1 in the leftmost ends of the upstream heads 31B have the same positions in the paper width direction.

By disposing the plurality of heads 31 in the head unit 30 in this manner, the nozzles can be aligned at equal intervals (720 dpi) across the entire range of the paper width direction. As a result, dot columns made of dots aligned at equal intervals (720 dpi) can be formed across the length of the paper width.

Figure 3:
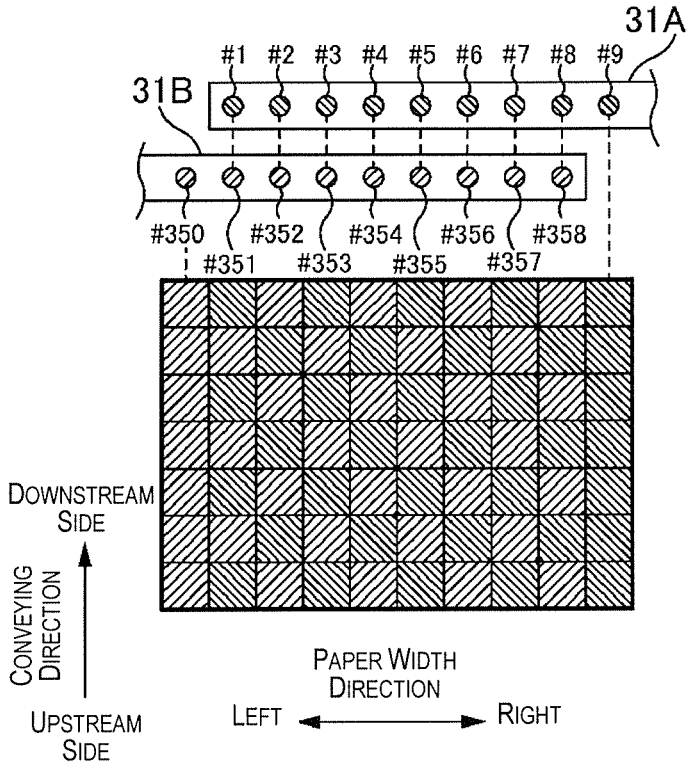
FIG. 3 is a drawing for describing pixels in which dots are formed by the nozzles of the head unit.

FIG. 3 is a drawing for describing pixels in which dots are formed by the nozzles of the head unit. This drawing shows a nozzle column of an upstream head 31B and a downstream head 31A. Below these nozzles, pixels in which dots are formed are shown as cells. In this drawing, the direction of hatching associated with the nozzles coincides with the direction of hatching of the pixels in which theses nozzles form dots. In the overlapping regions, two nozzle columns share the task of forming dots, as shown in the drawing.

<Density Correction Process of Comparative Example>

Next, a density correction process is described. The terms "pixel region" and "column region" are defined for the following description. The term "pixel region" refers to a region on the medium corresponding to a pixel, and the term "column region" refers to a region in which pixel regions are aligned in the conveying direction (also referred to as a "pixel column").

In the following description, the "density" read by a scanner is sometimes referred to as the "read gradation value." In other words, the "density" read by the scanner and the "read gradation value" have the same meaning.

Figure 4:
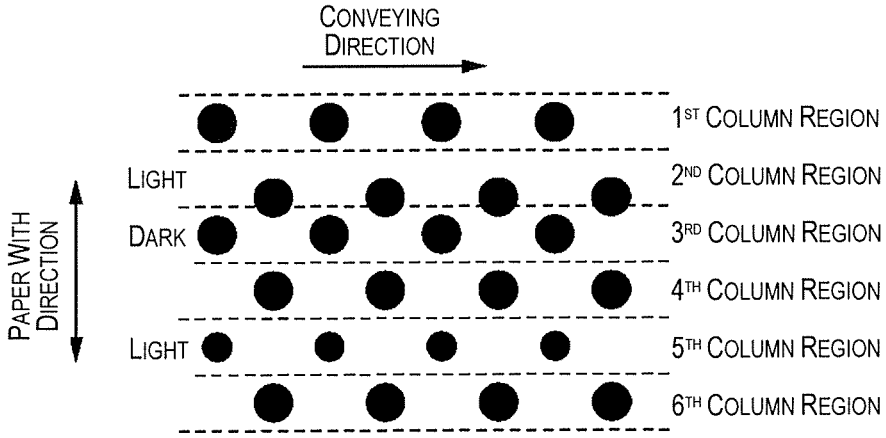
FIG. 4 is a drawing showing an example in which a dot line has an effect on the density of an adjacent dot line.

FIG. 4 is a drawing showing an example in which a dot line has an effect on the density of an adjacent dot line. In FIG. 4, the dot line formed in the second column region is formed near the third column region due to the trajectory of the ink droplets ejected from the nozzles being misdirected. As a result, the second column region appears lighter, and the third column region appears darker. The amount of ink droplets ejected in the fifth column region is less than the stipulated amount, and the dots formed in the fifth column region are smaller. As a result, the fifth column region is lighter. This appears on the image as a density discrepancy. Therefore, a lightly printed column region is corrected so as to be printed darkly, and a darkly printed column region is corrected so as to be printed lightly. The reason the third column region is darker is not because of the effect of the nozzles assigned to the third column region, but because of the effect of nozzles assigned to the adjacent second column region.

In view of this, the density correction process takes the effects of adjacent nozzles into account when calculating a correction value H for each column region (pixel column). The correction value H can be calculated for each model of printer 1 during the process of manufacturing the printer 1 or during maintenance. In this case, the correction value H is calculated according to a correction value acquisition program installed in the computer 50 connected to the printer 1. Hereinbelow is a description of the specific calculation method of the correction value for each column region.

Figure 5:
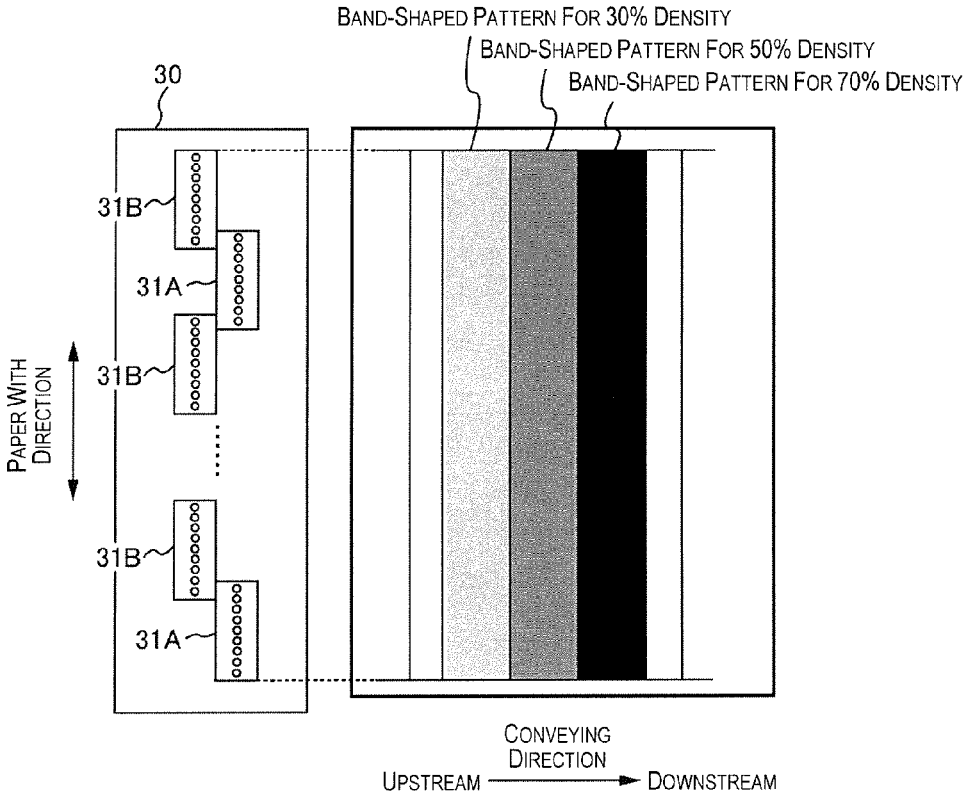
FIG. 5 is a drawing showing a density correction pattern.

FIG. 5 is a drawing showing a density correction pattern. A correction value acquisition program first causes the printer 1 to print a density correction pattern. The drawing shows a density correction pattern formed by one nozzle column among the nozzle columns (YMCK) of the heads 31. A density correction pattern for each nozzle column (YMCK) is printed as the density correction pattern.

The density correction pattern is configured from belt patterns of three different densities. The belt patterns are created from image data, each of certain gradation values. The gradation values for forming the belt patterns are referred to as command gradation values; the command gradation value of the band-shaped pattern for 30% density is expressed as Sa (76), the command gradation value of the band-shaped pattern for 50% density is expressed as Sb (128), and the command gradation value of the band-shaped pattern for 70% density is expressed as Sc (179). One correction pattern is configured from column regions equal to the number of nozzles aligned in the paper width direction in the head unit 30.

Figure 6:
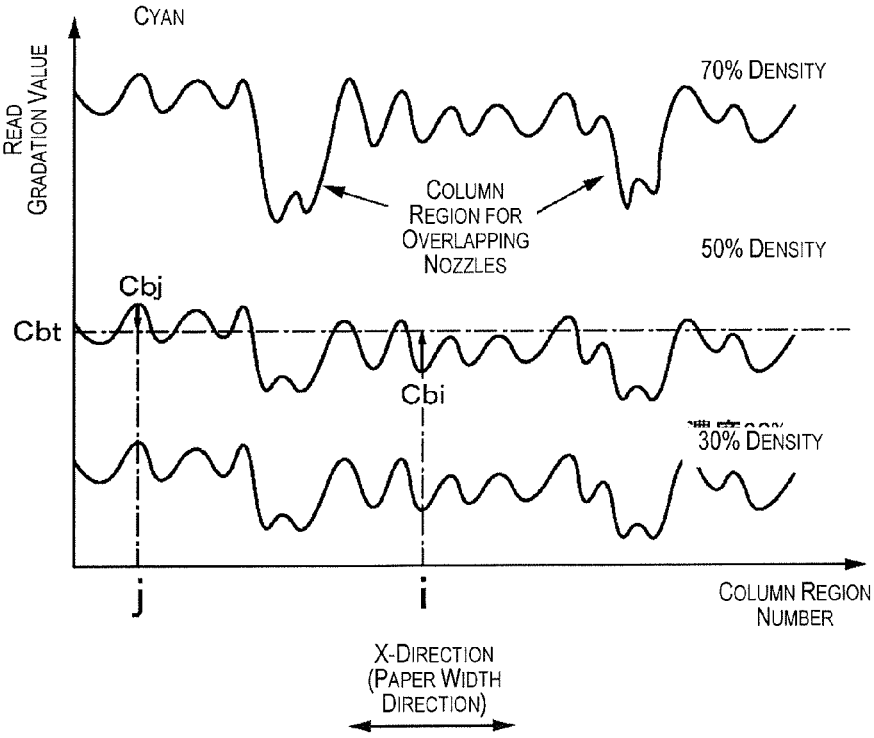
FIG. 6 shows the results of a cyan correction pattern read by a scanner.

FIG. 6 shows the results of a cyan correction pattern read by a scanner. Next, the correction value acquisition program acquires the results of the scanner reading the density correction pattern. The following description uses cyan read data as an example. The correction value acquisition program correlates the pixel columns in the read data one-on-one with the column regions constituting the correction pattern, the calculates the densities (the read gradation value) of the column regions for each belt pattern. Specifically, the average value of the read gradation value of the pixels belonging to the pixel columns associated with a certain column region are designated as the read gradation value of that column region. In the graph in FIG. 6, the horizontal axis represents the column region number, and the vertical axis represents the read gradation value of the column regions.

Regardless of whether or not each belt pattern is formed uniformly with its respective command gradation value, variation occurs in the read gradation value of each column region as shown in FIG. 6. For example, in the graph in FIG. 6, the read gradation value Cbi of the i column region is comparatively lower than the read gradation value of the other column regions, and the read gradation value Cbj of the j column region is comparatively higher than the read gradation value of the other column regions. Specifically, the i column region appears lighter and the j column region appears darker. Such variation in the read gradation value of the column regions produces density nonuniformity in the printed image.

The density nonuniformity caused by lightness of the overlapping region images and nozzle working precision can be improved by bringing the read gradation value of the column regions near to constant values. For one command gradation value (e.g., Sb·50% density) in the density correction process of a comparative example, the average value Cbt of the read gradation value of all column regions is set as the "target value Cbt." The gradation values expressing image data corresponding to the column regions are corrected so that the read gradation value of the column regions in the command gradation value Sb approach the target value Cbt.

Specifically, the gradation values expressing pixel column data corresponding to the column region i, which has lower read gradation value than the target value Cbt in FIG. 6, are corrected to darker gradation values than the command gradation value Sb. The gradation values expressing pixel column data corresponding to the column region j, which has higher read gradation value than the target value Cbt, are corrected to lighter gradation values than the command gradation value Sb. Thus, a correction value H for the same gradation values is calculated, which is used to correct the gradation values of pixel column data corresponding to the column regions in order to bring the densities of all column regions near to a constant value.

Figure 7A:
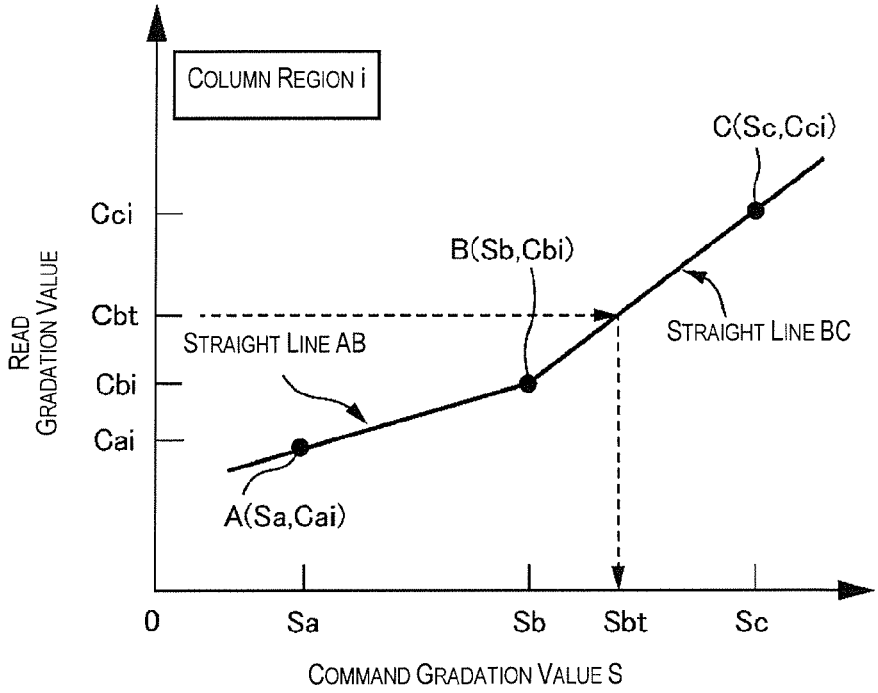
FIGS. 7A and 7B are graphs showing the specific method for calculating the density nonuniformity correction value H.
Figure 7B:
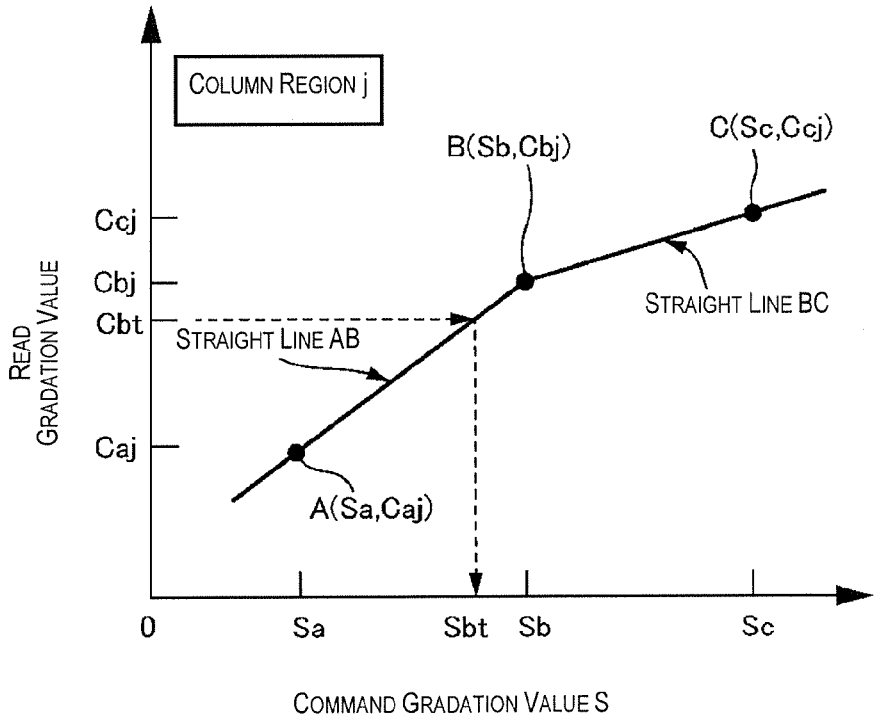

FIGS. 7A and 7B are graphs showing the specific method for calculating the density nonuniformity correction value H. First, FIG. 7A shows the manner in which a target command gradation value (e.g., Sbt) for a command gradation value (e.g., Sb) is calculated in the i column region having lower read gradation value than the target value Cbt. The horizontal axis represents the gradation values, and the vertical axis represents the read gradation value in the test pattern results. Theses graphs plot read gradation value (Cai, Cbi, Cci) relative to command gradation values (Sa, Sb, Sc). For example, the following formula (linear interpolation based on straight line BC) is used to calculate the target command gradation value Sbt for expressing the i column region as a target value Cbt relative to the command gradation value Sb.

$$Sbt=Sb+[(Sc-Sb)\times(Cbt-Cbi)/(Cci-Cbi)]$$

Similarly, in the j column region having higher read gradation value than the target value Cbt, the following formula (linear interpolation based on straight line AB) is used to calculate the target command gradation value Sbt for expressing the j column region as a target value Cbt relative to the command gradation value Sb, as shown in FIG. 7B.

$$Sbt=Sa+[(Sb-Sa)\times(Cbt-Caj)/(Cbj-Caj)]$$

Thus, the target command gradation value Sbt of each column region is calculated relative to the command gradation value Sb. The cyan correction value Hb relative to the command gradation value Sb of each column region is then calculated by the following formula. Correction values relative to other command gradation values (Sa, Sc) and correction values relative to other colors (yellow, magenta, black) are similarly calculated.

$$Hb=(Sbt-Sb)/Sb$$

Figure 8:
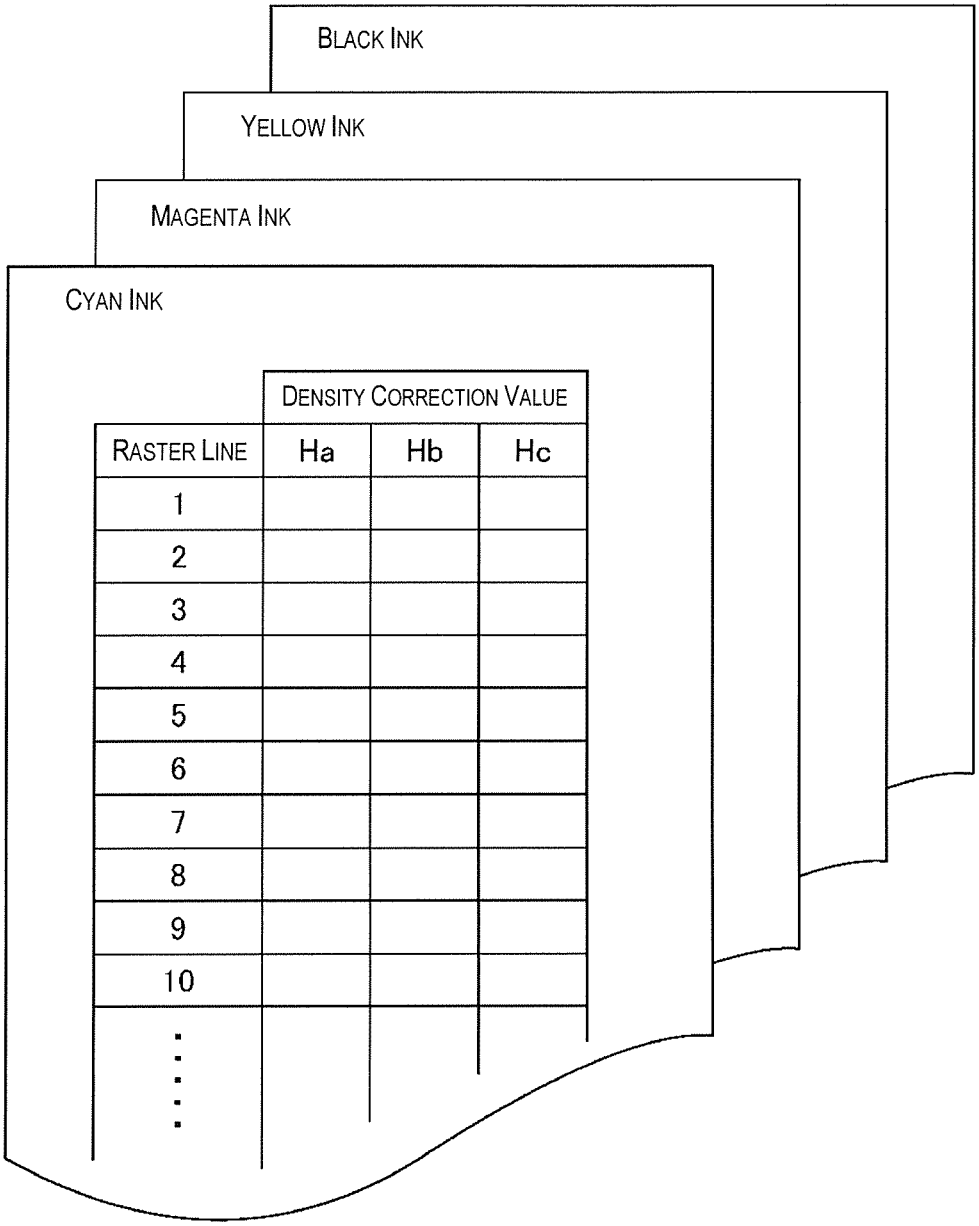
FIG. 8 is a chart showing a correction value table associated with the nozzle columns (CMYK)

FIG. 8 is a drawing showing a correction value table associated with each nozzle column (CMYK). The correction values H corrected as described above are compiled in the correction value table shown. In the correction value table, correction values (Ha, Hb, Hc) corresponding respectively to the three command gradation values (Sa, Sb, Sc) are set for reach column region. Such a correction value table is stored in the memory device 13 of the printer 1 which has printed the test pattern in order to calculate the correction values H. The printer 1 is afterwards shipped to the user.

When the user first uses the printer 1, the user installs a printer driver in the computer 50 connected to the printer 1. The printer driver then sends a request to the printer 1 so that the correction values H stored in the memory device 13 are sent to the computer 50. The printer driver stores the correction values H sent from the printer 1 in the memory device in the computer 50.

If the uncorrected gradation value S_in is the same as any of the command gradation values Sa, Sb, Sc, the correction values Ha, Hb, Hc which are correction values H corresponding to the command gradation values and are stored in the memory device of the computer 50 can be used as they are.

For example, if the uncorrected gradation value S_in is equal to Sc, the post-correction gradation value S_out is determined by the following formula.

$$S_out = Sc \times (1 + Hc)$$

Figure 9:
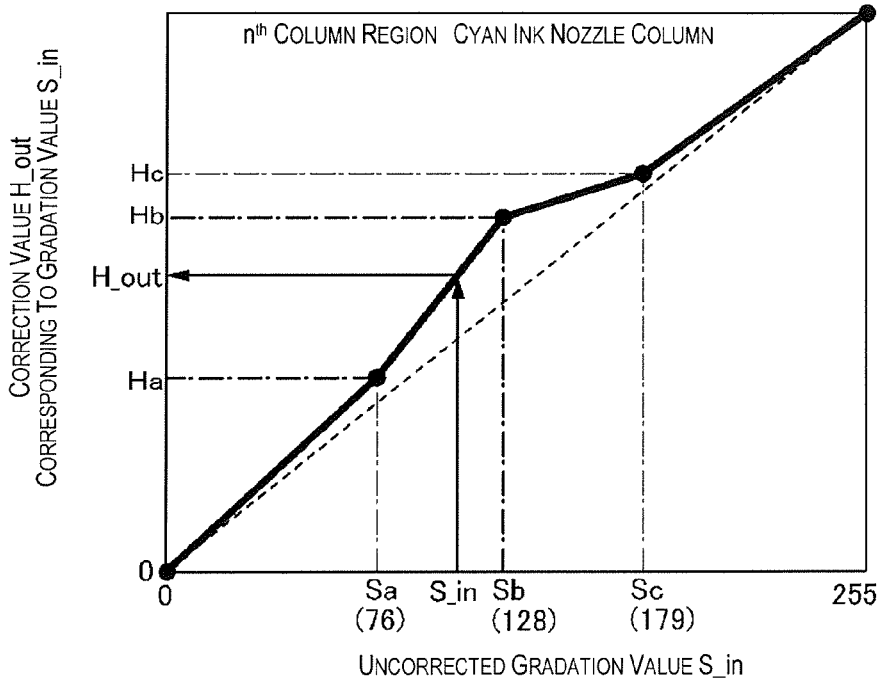
FIG. 9 is a graph showing the manner in which the correction values H corresponding to the gradation values are calculated relating to the nth cyan column region.

FIG. 9 is a graph showing the manner of calculating correction values H corresponding to the gradation values associated with the nth cyan column region. The horizontal axis represents the uncorrected gradation values S_, and the vertical axis represents the correction values H_out corresponding to the uncorrected gradation values S_in. When the uncorrected gradation value S_in differs from the command gradation value, a correction value H_out corresponding to the uncorrected gradation value S_in is calculated.

For example, when the uncorrected gradation value S_in is between the command gradation values Sa and Sb as shown in FIG. 9, the correction value H_out is calculated by the following formula through linear interpolation of the correction value Ha of the command gradation value Sa and the correction value Hb of the command gradation value Sb.

$$H_out = Ha + [(Hb - Ha) \times (S_in - Sa)/Sb - Sa)]$$

$$S_out = S_in \times (1 + H_out)$$

When the uncorrected gradation value S_in is less than the command gradation value Sa, the correction value H_out is calculated by linear interpolation of the minimum gradation value 0 and the command gradation value Sa, and when the uncorrected gradation value S_in is greater than the command gradation value Sc, the correction value H_out is calculated by linear interpolation of the maximum gradation value 255 and the command gradation value Sc.

Thus, the printer driver corrects the gradation values S_in shown by each of the pixels (256 gradation data) in the density correction process according to the correction values H set for each color, each column region associated with the image data, and each gradation value. Thus, gradation values S_in of pixels corresponding to column regions that appear lighter in density are corrected to dark gradation values S_out, and gradation values S_in shown by pixels corresponding to column regions that appear darker in density are corrected to light gradation values S_out.

<Problems with Comparative Example>

When the medium has shifted while being conveyed, dots are sometimes formed in different positions from which the dots were originally supposed to be formed. Downstream heads will sometimes form dots over the dots formed by upstream heads, and any head can have pixels in which no dots are formed. Such misalignment in the deposited positions of the ink in the overlapping regions of the heads causes color nonuniformity and reduces image quality.

To suppress such color nonuniformity, density correction such as that of the above-described comparative example is performed. However, with a method such as that of the above-described comparative example, the reference for judging density magnitude corresponds to the average density value in all of the pixel columns. In such cases, depending on the average value, there is a risk that the correction will be insufficient in high-duty (high-density) printing. For example, if a correction is made such that printing is performed with a duty higher than the highest duty, it will not be possible to output any higher of a duty, and as a result, the density will be insufficient.

Figure 10:
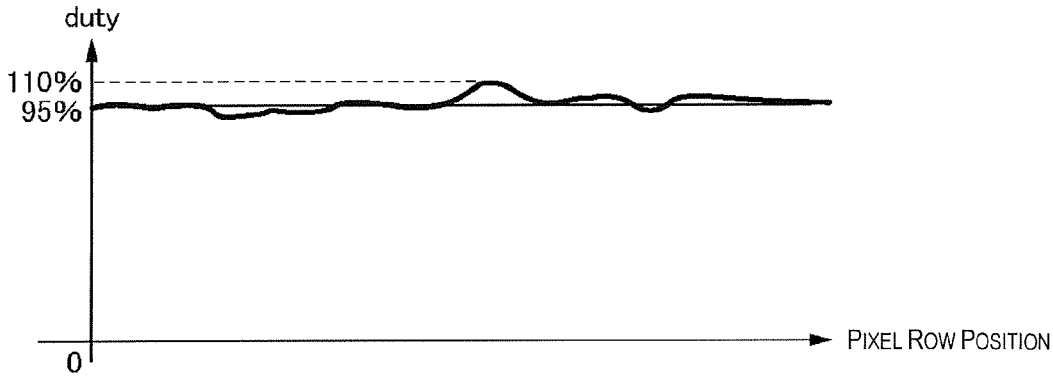
FIG. 10 is a graph describing output after density correction in a comparative example.

FIG. 10 is a graph describing output after density correction in a comparative example. This graph shows pixel column positions and duty output corresponding to pixel column positions. The term "duty" herein refers to the amount of ink deposited in a pixel. In the present embodiment, when the duty is 100%, the amount is such that all pixels are completely filled in with monochromatic ink. With the printer 1 of the present embodiment, the maximum amount of ink that can be ejected in the nozzles is an amount corresponding to a duty of 100%, when the gradation value is 255.

In FIG. 10, when the print duty is 95%, the duty after density correction shows the type of value. Referring to the chart, there is a pixel column in which the duty after density correction exceeds 100%. Since only a duty up to 100% can be outputted, density correction in this area cannot be performed sufficiently.

To avoid instances in which it is thus not possible to perform density correction, the density correction value can be determined so that the density of the pixel column having the lowest density is used as the reference. However, since there are many cases in which the density in the overlapping regions is generally low as previously described, when the density correction value is determined merely so that this reference is used, the density of the non-overlapping regions decreases severely. As a result, the gradation range narrows and coloring performance suffers.

Consequently, in the embodiment described hereinbelow, density correction is performed appropriately while an effort is made to prevent such problems from occurring.

Figure 11:
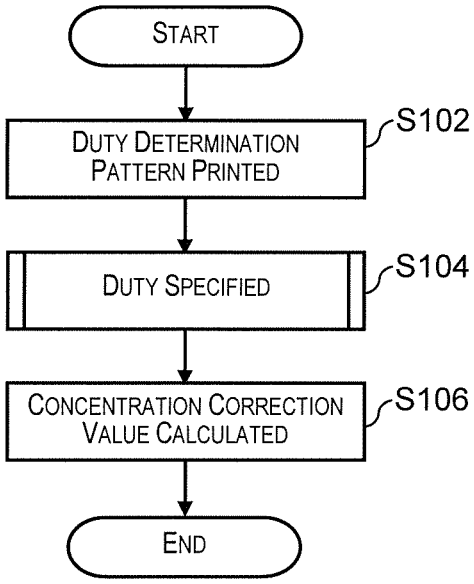
FIG. 11 is a flowchart of the density correction value calculation method in the present embodiment.
Figures 12A, 12B:
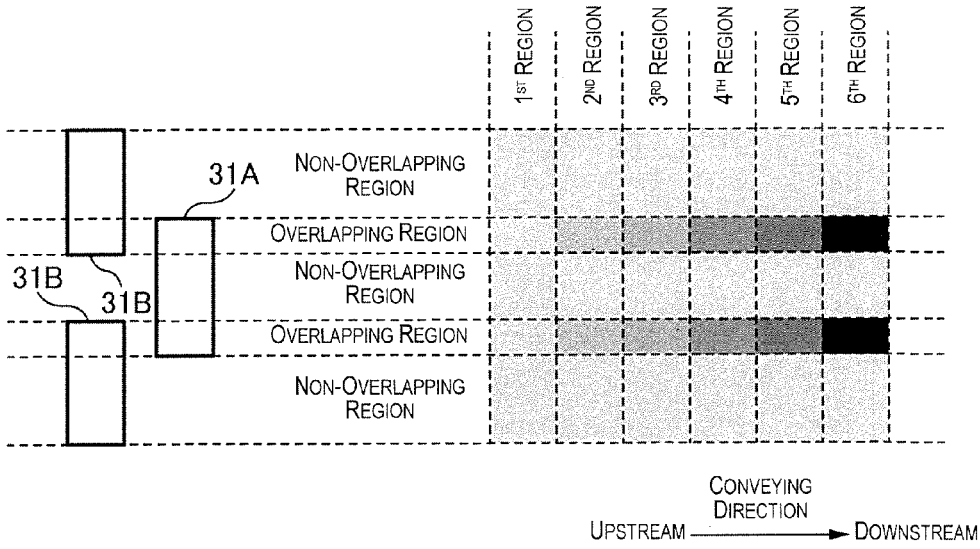
FIG. 12A is an explanatory chart of the duties in the duty determination pattern in the present embodiment.
FIG. 12B is an explanatory chart of the duty determination pattern in the present embodiment.

FIG. 11 is a flowchart of the density correction value calculation method in the present embodiment. First, a duty determination pattern is printed in order to determine the duty in an overlapping region (S102). FIG. 12A is an explanatory chart of the duties in the duty determination pattern in the present embodiment. FIG. 12B is an explanatory chart of the duty determination pattern in the present embodiment. FIG. 12B shows upstream heads 31B and a downstream head 31A which print the duty determination pattern. Also shown is a duty determination pattern formed by ejecting ink from these heads while the medium is being conveyed in the conveying direction.

The duty determination pattern includes a pattern of non-overlapping regions formed by nozzles belonging to non-overlapping regions, and a pattern of overlapping regions formed by nozzles belonging to overlapping regions. The non-overlapping region pattern is a pattern printed by the nozzles belonging to the non-overlapping regions ejecting ink with the highest duty of 100%. The overlapping region pattern is a pattern printed by ink ejected from the nozzles of the upstream heads 31B and the nozzles of the downstream head 31A belonging to the overlapping regions.

The duties of the nozzles in the overlapping regions are as shown in FIG. 12A. The duty determination pattern in the overlapping regions can be divided into first through sixth regions. In the first region, the nozzles of the upstream heads 31B eject ink with a duty of 50% in the overlapping regions, and the nozzles of the downstream head 31A eject ink with a duty of 50%. In other words, the total duty of the overlapping regions is 100%.

In the second region, the nozzles of the upstream heads 31B and the nozzles of the downstream head 31A both eject ink with a duty of 60% in the overlapping regions. In other words, the total duty of the overlapping regions is 120%. Similarly, the duty of the nozzles belonging to the overlapping regions is increased in incremental steps and ink is ejected in the third through sixth regions as well. Thus, the total duty of the sixth region is ultimately 200%.

Figure 13:
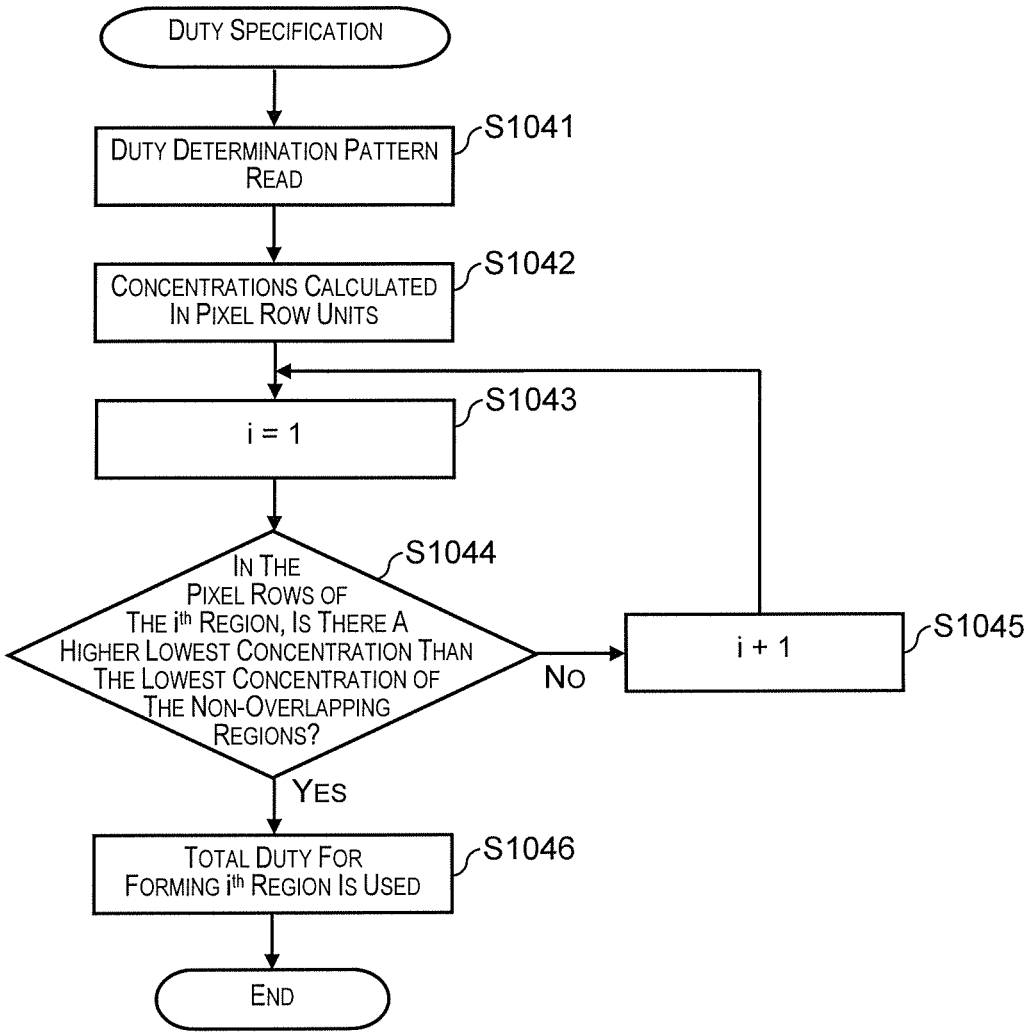
FIG. 13 is a flowchart of the process of specifying duty.

Next, a total duty is specified at which the lowest density of the densities of the pixel columns in the overlapping regions is equal to or greater than the lowest density in the pixel columns of the non-overlapping regions (S104). FIG. 13 is a flowchart of the process of specifying duty. First, the duty determination pattern printed as previously described is read by a scanner (S1041). The average density value is then determined in pixel column units for each of the first through sixth regions. The average density value is also determined in pixel column units for the non-overlapping regions (S1042).

The lowest density of the pixel column densities of the first region is then specified. The lowest density of the pixel column densities of the non-overlapping regions is also specified. Whether or not the lowest density of the first region is equal to or greater than the lowest density of the non-overlapping regions is also determined (S1043, S1044). When it is equal to or greater than the lowest density of the non-overlapping regions, it is determined that the duties used will be 50% and 50%, which is the total duty for forming the first region (S1046). When it is equal to or less than the lowest density of the non-overlapping regions, the target is the second region (S1045), and whether or not the lowest density of the second region is equal to or greater than the lowest density of the non-overlapping regions is determined (S1043, S1044).

By repeating this action until the maximum sixth region, it is possible to specify the total duty at which the lowest density of the pixel column densities of the overlapping regions will be equal to or greater than the lowest density in the pixel columns of the non-overlapping regions.

When specifying the total duty is thus finished, the nozzles of the overlapping regions are made to print a density correction pattern with the total duty that has been specified, and a density correction value is calculated (S106). As previously described, a band-shaped pattern for 30% density, a band-shaped pattern for 50% density, and a band-shaped pattern for 70% density are used here. For example, when the specified total duty is 120%, the belt pattern that had a 30% density in the overlapping regions would be a belt pattern of 30%× 1.2=36%. The belt pattern having a density of 30% in the non-overlapping regions, however, would remain at 30%. Specifically, in the overlapping regions, a density correction pattern is printed in belt patterns of densities equal to or greater than those of the non-overlapping regions.

The method for calculating the density correction value using the density correction pattern is substantially the same as the comparative example described above. In the comparative example, the average value Cbt of the read gradation value of all the column regions was set as the "target Cbt," but in the present embodiment, the read gradation value having the lowest density in all of the column regions is set as the "target value Cbt." By setting the target value in this manner, it is possible to determine a density correction value such that the density will not be insufficient.

The density correction values determined in this manner are stored in the memory device 13 for each printer 1. The total duty used in the overlapping regions is also stored in the memory device 13 for each printer 1. The overlapping regions use the total duty thus used when printing is performed, and these density correction values are used to perform printing.

Thus, printing can be appropriately performed without causing density insufficiency or loss of coloring performance when density correction is performed.

—Other Embodiments—

In the embodiments described above, a printing system having an inkjet printer was primarily described, but the embodiments also include the disclosure of a density nonuniformity correction method or the like. The embodiments described above are intended to make the invention easier to understand, and should not be interpreted as limiting the invention. The invention can be modified or improved without deviating from the scope thereof, and the invention of course includes other equivalents. The following embodiment in particular is included in the invention.

<Fluid Ejection Device>

In the embodiments previously described, an inkjet printer was given as an example of a fluid ejection device, but the fluid ejection device is not limited thereto. As long as it is a fluid ejection device, it can be applied to various industrial devices other than a printer. For example, the invention can also be applied to a printing device for printing a design on cloth; a color filter manufacturing device, an organic EL device, or another display manufacturing device; a DNA chip manufacturing device for manufacturing DNA chips by coating chips with a solution containing dissolved DNA; and the like. The fluid ejection system can also be a piezo system in which fluid is ejected by applying voltage to drive elements (piezo elements) to expand and contract ink chambers, or a thermal system in which heat-generating elements are used to create air bubbles in the nozzles, and a liquid is ejected by the air bubbles. The fluid is not limited to ink or other liquids, and can be a powder or the like.

What is claimed is:

1. A density correction value calculation method for a printing device comprising:

a first nozzle column in which first nozzles for ejecting ink are aligned in a predetermined direction;

a second nozzle column in which second nozzles for ejecting the ink are aligned in the predetermined direction, the second nozzle column being disposed to form an overlapping region in which an end on one side in the predetermined direction overlaps an end on the other side in the predetermined direction of the first nozzle column; and a movement part for relatively moving a medium in an intersecting direction that intersects the predetermined direction;

wherein the printing device ejects the ink in the overlapping region with a total duty divided between the first nozzles and the second nozzles;

the correction value calculation method comprising the steps of:

(A) determining the density of each pixel column composed of pixels aligned in the intersecting direction in a duty determination pattern, and also determining the density of each pixel column in the duty determination pattern in which a plurality of overlapping region patterns are formed with a total duty higher than the highest duty of non-overlapping regions which are not the overlapping regions;

(B) specifying the total duty for which the lowest density of the pixel column densities of the overlapping regions is equal to or greater than the lowest density in the pixel columns of the non-overlapping regions; and (C) calculating a density correction value of the pixel columns using a density correction pattern formed with the specified total duty, and also calculating a density correction value so that the lowest density of the pixel column densities of the density correction pattern is a reference.

2. The correction value calculation method according to claim 1, wherein a plurality of the overlapping region patterns of the duty determination pattern are formed with total duties that differ incrementally.

3. The correction value calculation method according to claim 1, wherein the overlapping region patterns of the duty determination pattern are formed with a duty divided equally between the first nozzles and the second nozzles.

4. The correction value calculation method according to claim 1, wherein the density correction pattern is a pattern for performing a density correction for each pixel column composed of pixels aligned in the intersecting direction.

5. The correction value calculation method according to claim 1, wherein when the density correction value is calculated, the density of the formed density correction pattern is determined in units of the pixel columns, and the density correction value is calculated based on the densities of each of the determined pixel columns.

6. The correction value calculation method according to claim 1, wherein when the density correction value is calculated, the density correction value is calculated by multiplying a ratio such that the lowest density of the densities of pixel columns of the density correction pattern is a reference.

7. The correction value calculation method according to claim 1, wherein during formation of the duty determination pattern, patterns in the non-overlapping regions are formed with only the highest duty.

8. A printing device comprising:

a first nozzle column in which first nozzles for ejecting ink are aligned in a predetermined direction;

a second nozzle column in which second nozzles for ejecting the ink are aligned in the predetermined direction, the second nozzle column being disposed to form an overlapping region in which an end on one side in the predetermined direction overlaps an end on the other side in the predetermined direction of the first nozzle column; and a movement part for relatively moving a medium in an intersecting direction that intersects the predetermined direction;

wherein the printing device ejects the ink in the overlapping region with a total duty divided between the first nozzles and the second nozzles;

a controller performing operations of:

(A) determining the density of each pixel column composed of pixels aligned in the intersecting direction in a duty determination pattern, and also determining the density of each pixel column in the duty determination pattern in which a plurality of overlapping region patterns are formed with a total duty higher than the highest duty of non-overlapping regions which are not the overlapping regions;

(B) specifying the total duty for which the lowest density of the pixel column densities of the overlapping regions is equal to or greater than the lowest density in the pixel columns of the non-overlapping regions; and (C) calculating a density correction value of the pixel columns using a density correction pattern formed with the specified total duty, and also calculating a density correction value so that the lowest density of the pixel column densities of the density correction pattern is a reference.

* * * * *